US006746538B2

(12) United States Patent
Grammatica et al.

(10) Patent No.: US 6,746,538 B2
(45) Date of Patent: Jun. 8, 2004

(54) APPARATUS AND METHOD FOR COATING PHOTORECEPTOR SUBSTRATES

(75) Inventors: Steven J. Grammatica, Penfield, NY (US); Eugene A. Swain, Webster, NY (US); Christopher R. Fridd, Rochester, NY (US); Kathryn T. Lalone, Muskego, NY (US)

(73) Assignee: Xerox Corporation Stamford, CT (US)

( * ) Notice: Subject to any disclaimer, the term of this patent is extended or adjusted under 35 U.S.C. 154(b) by 0 days.

(21) Appl. No.: 10/287,754

(22) Filed: Nov. 1, 2002

(65) Prior Publication Data

US 2003/0064166 A1 Apr. 3, 2003

Related U.S. Application Data

(62) Division of application No. 09/969,387, filed on Oct. 2, 2001.

(51) Int. Cl.[7] ..... B05C 3/00
(52) U.S. Cl. ..... 118/429; 118/400
(58) Field of Search ..... 118/DIG. 5, 429, 118/428, 400, DIG. 11, DIG. 12, 423

(56) References Cited

U.S. PATENT DOCUMENTS 3,178,308 A * 4/1965 Oxlcy et al.
4,381,728 A * 5/1983 Walling et al.
5,681,392 A 10/1997 Swain ..... 118/407

* cited by examiner

*Primary Examiner*—Brenda A. Lamb
(74) *Attorney, Agent, or Firm*—Wayne J. Egan

(57) ABSTRACT

An apparatus for coating a photoreceptor substrate, such as a photoreceptor belt or a photoreceptor drum, consists of at least one photoreceptor coating fluid reservoir or diptank. The diptank defines an inlet at one end and a conduit with an orifice at the other end. The conduit includes at least one porous element such as a grid, screen or mesh arranged for suspending a plurality of layers of non-contaminating rounded objects, such as stainless steel or glass beads, in the bottom of the conduit. Photoreceptor coating solution supplied to the inlet is thereby forced to flow through the plurality of layers of beads prior to coating a photoreceptor substrate that is inserted through the orifice. As a result, the uniformity of the coating solution is improved as it coats the photoreceptor substrate, thereby reducing coating defects in the finished photoreceptor belt or drum.

24 Claims, 7 Drawing Sheets

FIG. 2A
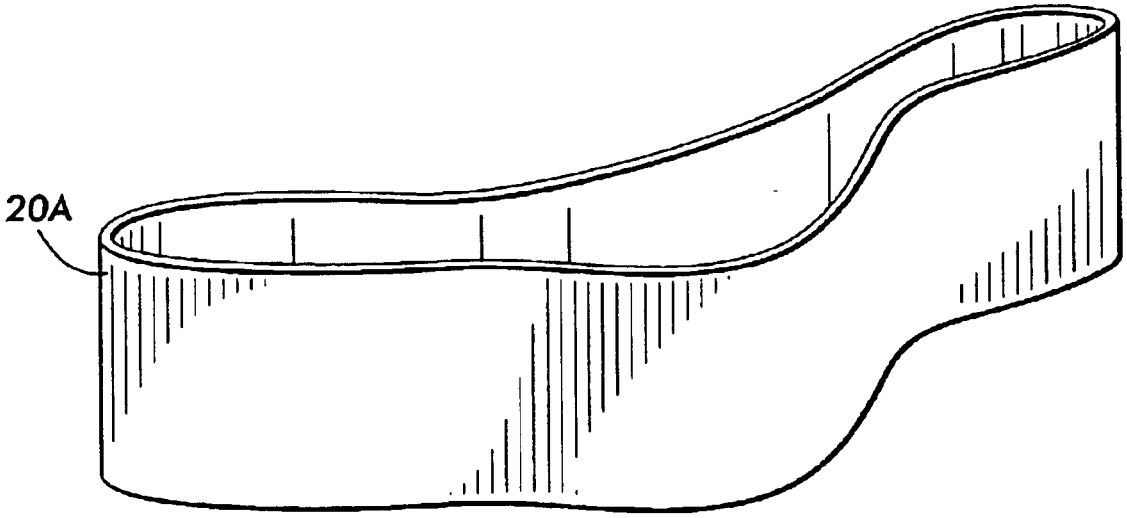
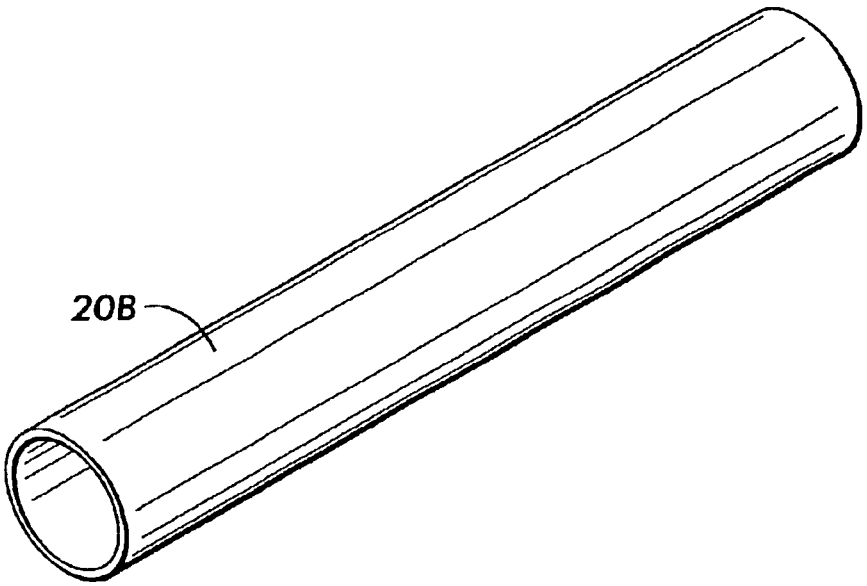
FIG. 2B

FIG. 3A
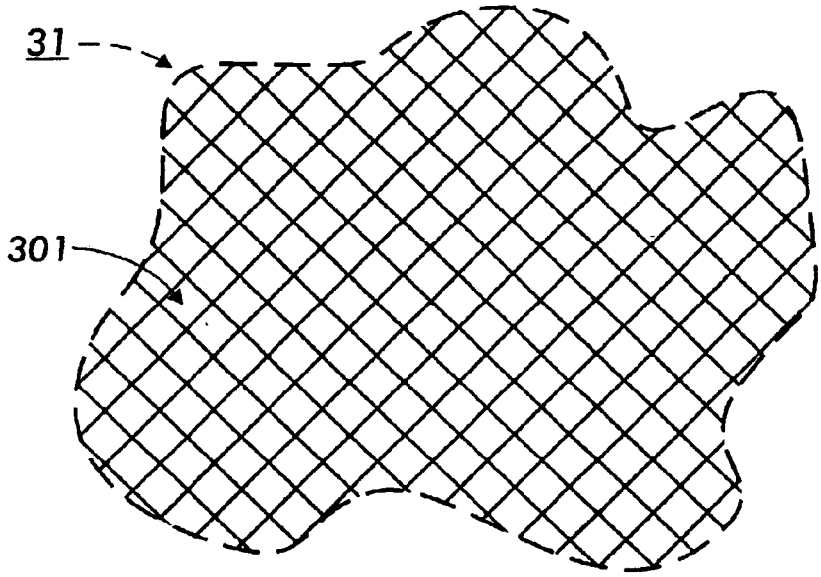
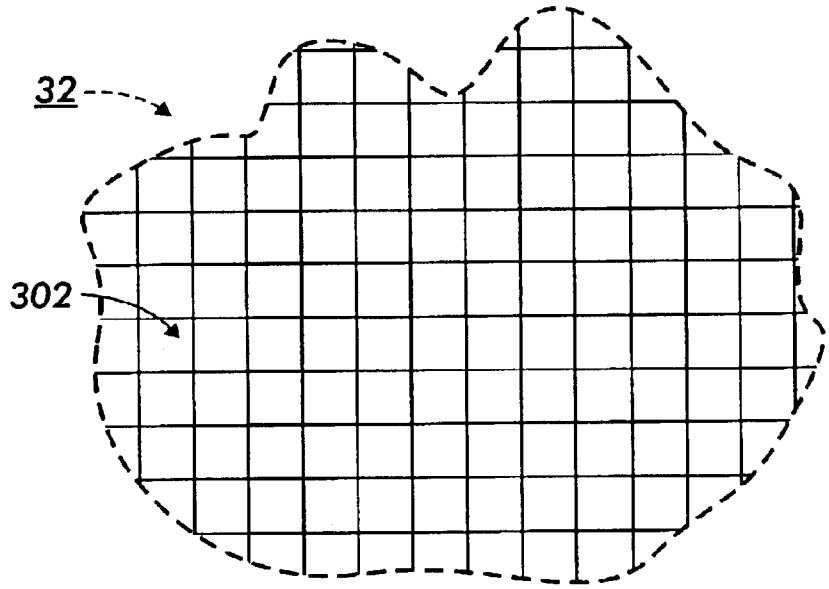
FIG. 3B

APPARATUS AND METHOD FOR COATING PHOTORECEPTOR SUBSTRATES

CROSS-REFERENCE TO RELATED APPLICATIONS

This is a divisional application of Ser. No. 09/969,387 filed Oct. 2, 2001, now pending.

INCORPORATION BY REFERENCE OF OTHER U.S. PATENT

The disclosure of commonly-assigned U.S. Pat. No. 5,681,392 by Eugene A. Swain, entitled "Fluid reservoir containing panels for reducing rate of fluid flow," issued Oct. 28, 1997 is hereby incorporated by reference in this application verbatim, with the same effect as though such disclosure were fully and completely set forth herein. It is noted that the same Eugene A. Swain is a named inventor both in the foregoing U.S. patent and in the present application.

TECHNICAL FIELD

This invention relates to coating photoreceptor substrates using dip tanks and more particularly to coating photoreceptor substrates using a dip tank arranged with a plurality of layers of rounded objects or beads.

BACKGROUND OF THE INVENTION

It is known to use coating fluid reservoirs or "diptanks" to apply photoreceptor coating solution to coat photoreceptor devices such as photoreceptor flexible belts and cylindrical-shaped drums. In the foregoing U.S. Pat. No. 5,681,392 to Eugene A. Swain, for example, the fluid reservoir (equivalent to a diptank) 10 is used to supply organic photoreceptor coating fluid 80 to coat a flexible belt-type photoreceptor substrate 60.

In this coating process, a photoreceptor substrate (belt or drum) is immersed or "dipped" into the orifice of a tank containing the solution to be coated and then withdrawn at a rate that controls the coating thickness. The usual mechanism to coat the substrate is to pump a coating solution containing the active materials, either dissolved or in suspension (such as pigments), into the tank from an inlet located in the bottom of the diptank and continuously overflow the tank at the orifice located at the top of the tank. In this way the substrate is subjected to a uniform flow of solution relative to the coating speed.

There are several disadvantages to the dip coating process which can result in defects on the coated substrate surface.

For example, typically there is very little radial surface velocity of the coating solution at the top of the tank. In fact, usually there is a conical volume in the tank where there is relatively little coating solution flow. As a result of non-uniformities in the coating solution, coating streaks can occur along part or all of the dipped length of the photoreceptor substrate. Such non-uniformities can occur especially from dispersions that have poor stability and display a property of non-uniform dispersion distribution called flocculation.

As is known, flocculation occurs when there is little or no movement or shear of the solution, such as the conical volume of the tank discussed above. Flocculation results in solvent-rich and pigment-rich zones in the dip tank. Unfortunately, such zones are exactly where the photoreceptor substrate is immersed. Ultimately, these phenomena can result in coating streaks or other defects in the resulting finished photoreceptor device.

As a result, there is a need for an improved apparatus and method for coating photoreceptor substrates.

SUMMARY OF THE INVENTION

In one aspect of the invention, there is provided an apparatus for coating at least one substrate with a fluid. The apparatus comprises at least one diptank defining an inlet and a conduit with an orifice, the conduit including means for suspending a plurality of layers of rounded objects so that fluid supplied to the inlet flows through the plurality of layers of rounded objects to coat a substrate that is inserted through the orifice.

In another aspect of the invention, there is provided a method for coating at least one substrate with a fluid. The method uses an apparatus comprising at least one diptank defining an inlet and a conduit with an orifice, the conduit including means for suspending a plurality of layers of rounded objects, so that fluid supplied to the inlet flows through the plurality of layers of rounded objects to coat a substrate that is inserted through the orifice. The method comprises supplying fluid to the inlet and inserting at least one substrate through the orifice.

BRIEF DESCRIPTION OF THE DRAWING

FIG. 2A depicts a photoreceptor belt substrate 20A that may be coated by the FIG. 1 apparatus.

FIG. 2B depicts a photoreceptor drum substrate 20B that may be coated by the FIG. 1 apparatus.

FIG. 3A depicts a first porous element 31 of the apparatus 100.

FIG. 3B depicts a second porous element 32 of the apparatus 100.

DESCRIPTION OF THE PREFERRED EMBODIMENTS

Briefly, there is disclosed an apparatus for coating a photoreceptor substrate, such as a photoreceptor belt or a photoreceptor drum. The apparatus comprises at least one photoreceptor coating fluid reservoir or diptank. The diptank defines an inlet at one end and a conduit with an orifice at the other end. The conduit includes at least one porous element such as a grid, screen or mesh arranged for suspending a plurality of layers of non-contaminating rounded objects, such as stainless steel or glass beads, in the bottom of the conduit. Photoreceptor coating solution supplied to the inlet is thereby forced to flow through the plurality of layers of beads prior to coating a photoreceptor substrate that is inserted through the orifice. As a result, the uniformity of the coating solution is improved as it coats the photoreceptor substrate, thereby reducing coating defects in the finished photoreceptor belt or drum.

Referring now generally to FIGS. 2A–2B, there are shown typical photoreceptor substrates which may be used relative to the present invention. For example, in FIG. 2A there is shown a flexible photoreceptor belt substrate 20A and in FIG. 2B there is shown a cylindrical-shaped photoreceptor drum substrate 20B.

Figure 1:
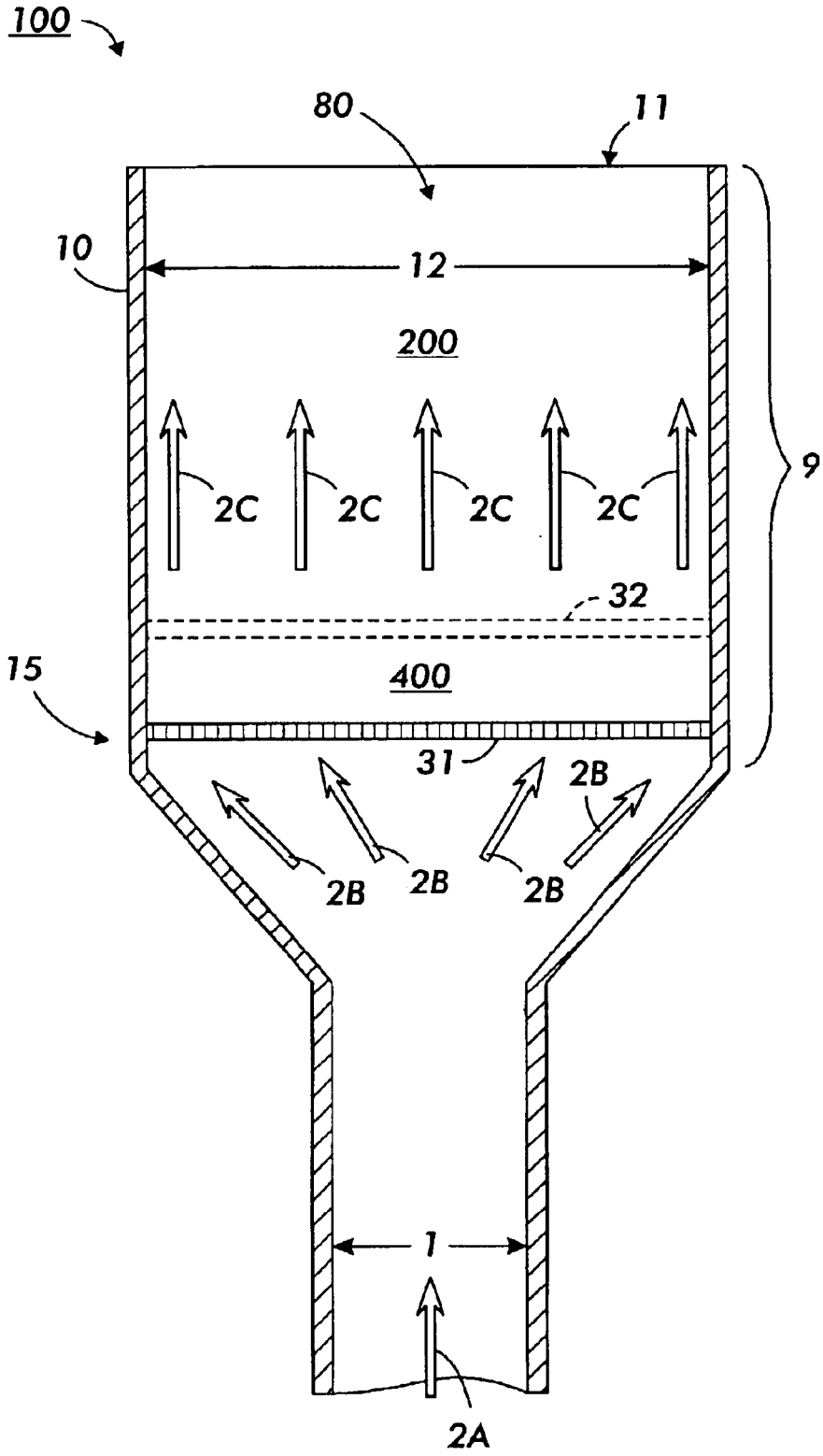
FIG. 1 depicts an apparatus 100 for coating photoreceptor substrates in accordance with the present invention.

Referring now to FIG. 1, there is shown an apparatus 100 for coating at least one of the foregoing substrates 20A and 20B with a fluid 200. In one embodiment, the fluid 200 comprises photoreceptor coating solution.

As shown in FIG. 1, the apparatus 100 comprises at least one diptank 10. The diptank 10 defines an inlet 1 at one end and a conduit 9 with an orifice 11 at the other end. In turn, the conduit 9 forms a conduit inner diameter 12. As discussed in greater detail below, the conduit 9 includes means 31–32 for suspending a plurality of layers of rounded objects or beads 400 substantially across and thereby covering the conduit inner diameter 12. As shown, the plurality of layers of rounded objects 400 are suspended near the bottom 15 of the conduit 9. Thus suspended, the plurality of layers of rounded objects 400 are positioned between the inlet 1 and the orifice 11. Moreover, as a result of such position, substantially all of the fluid 200 that is supplied 2A to the inlet 1 initially is forced to flow 2B through the plurality of layers of rounded objects 400 before later flowing 2C towards the orifice 11, thereby coating a substrate 20A or 20B that previously has been inserted or dipped 80 through the orifice 11.

Still referring to FIG. 1, in one embodiment, the means for suspending the rounded objects 400 comprise only a first, lower, porous element 31, with the rounded objects 400 being disposed on top of the porous element 31. In another embodiment, the means for suspending the rounded objects 400 comprise both the foregoing first, lower, porous element 31 and also a second, upper, porous element 32, with the rounded objects 400 being disposed between the first porous element 31 and the second porous element 32.

Turning now to FIG. 3A, it is seen that the first porous element 31 has a plurality of apertures 301 dispersed throughout. As well, turning now to FIG. 3B, it is seen the second porous element 32 likewise has a plurality of apertures 302 dispersed throughout.

In one embodiment, either or both of the porous elements 31 and 32 comprise a grid, screen or mesh.

In another embodiment, either or both of the porous elements 31 and 32 are similar to the porous membrane 30 of the foregoing U.S. Pat. No. 5,681,392.

In still another embodiment, either or both of the porous elements 31 and 32 are similar to the perforated plate 40 of the foregoing U.S. Pat. No. 5,681,392.

Figure 4:
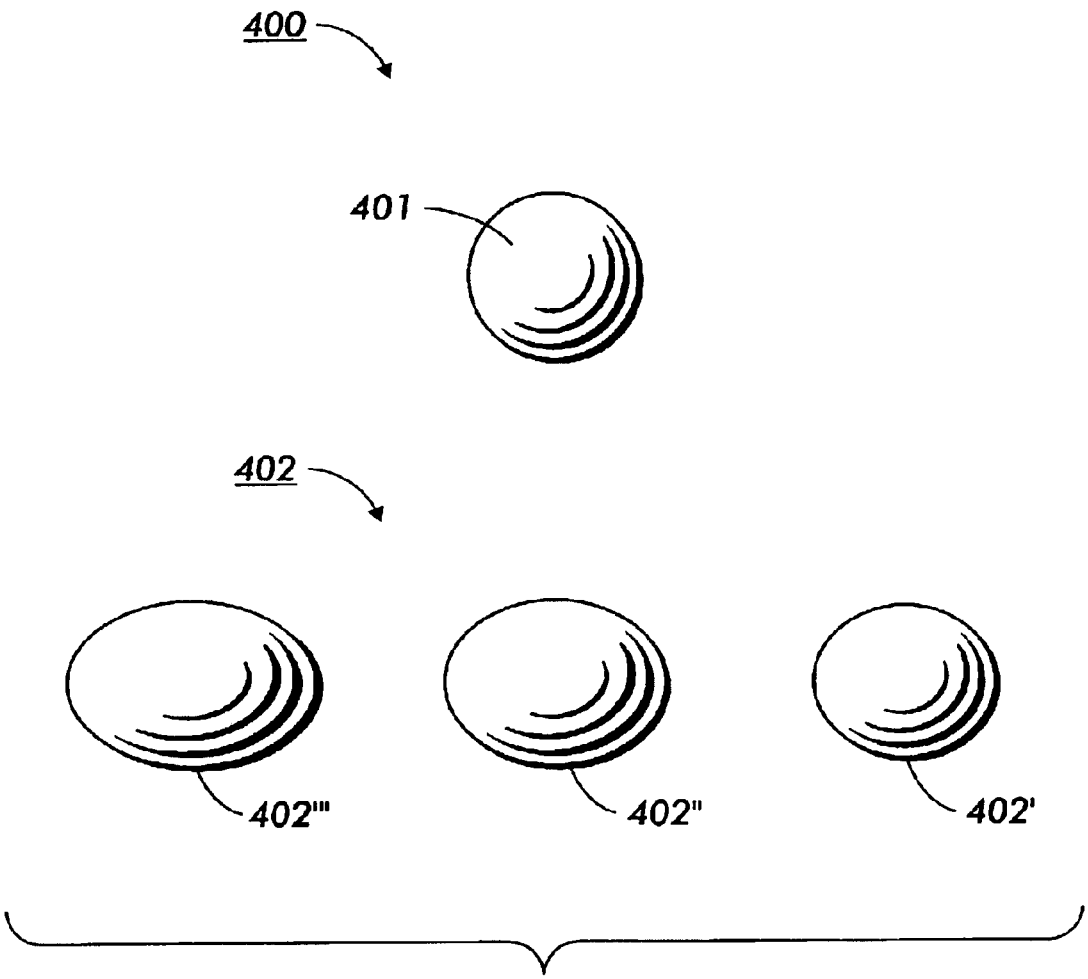
FIG. 4 depicts various embodiments of rounded objects or beads 400 that may be used in the apparatus 100. As shown, the rounded objects 400 include a spherical-shaped embodiment 401 and an elliptical-shaped embodiment 402. As shown, the latter elliptical embodiment 402 also includes other embodiments 402', 402" and 402'".

Referring now to FIG. 4, there are shown various embodiments of the FIG. 1 rounded objects 400. As shown, the rounded objects 400 comprise spherical-shaped objects, such as the depicted spherical object 401; elliptical-shaped objects, such as the depicted elliptical objects 402; and a mixture of spherical objects 401 and elliptical objects 402.

Referring still to FIG. 4, it will be understood the depicted elliptical-shaped object 402 includes variations thereof, including the depicted elliptical object embodiments 402', 402" and 402'". While only the elliptical embodiments 402', 402" and 402'" are shown, it will be understood that still other embodiments of the elliptical-shaped object 402 are possible.

Still referring to FIG. 4, the rounded objects 400 of the present invention, including the foregoing spherical object 401 and the elliptical object 402 (including the elliptical embodiments 402', 402" and 402'"), have a smooth surface, are non-contaminating, with diameters varying from 10 to 30 millimeters. It will be understood that the rounded objects 400 are commonly known as "beads".

In one embodiment, the rounded objects 400 are generally comprised of glass.

In another embodiment, the rounded objects 400 are generally comprised of a ceramic material such as, for example, porcelain, aluminum oxide, titanium dioxide, or equivalents thereof.

In still another embodiment, the rounded objects 400 are generally comprised of metal such as, for example, aluminum, stainless steel or titanium.

Returning momentarily to FIG. 1, in one embodiment the apparatus 100 comprises a plurality of layers of rounded objects 400 wherein substantially all of the rounded objects 400 are comprised of a single (1) material, such as glass, ceramic, or metal. In contrast, in another embodiment, the apparatus 100 comprises a plurality of layers of rounded objects 400 comprised of more than one (1) material. As an example of this latter contrasting embodiment, for example, a hypothetical apparatus 100 might comprise a plurality of layers of rounded objects 400 wherein 50% of the rounded objects 400 are comprised of glass, and the remaining 50% of the rounded objects 400 are comprised of metal.

Still referring to FIG. 1, in one embodiment the apparatus 100 comprises a plurality of layers of rounded objects 400 wherein substantially all of the rounded objects 400 are comprised of similar dimensions or diameters. In contrast, in another embodiment, the apparatus 100 comprises a plurality of layers of rounded objects 400 comprised of different or varying dimensions. As an example of this latter contrasting embodiment, for example, a hypothetical apparatus 100 might comprise a plurality of layers of rounded objects 400 wherein 35% of the rounded objects 400 have diameters of 10 millimeters, and the remaining 65% of the rounded objects 400 have diameters of 20 millimeters.

Referring now generally to FIGS. 5–7, there is depicted various embodiments of the apparatus 100 comprising a plurality of layers of rounded objects 400 suspended in the conduit 9 by the suspending means 31–32, as depicted in FIG. 1.

FIGS. 5–7 are briefly summarized as follows:

FIG. 5 depicts various embodiments of the apparatus 100 wherein the plurality of layers of rounded objects 400 generally comprise the spherical objects 401.

FIG. 6 depicts various embodiments of the apparatus 100 wherein the plurality of layers of rounded objects 400 generally comprise the elliptical objects 402.

FIG. 7 depicts various embodiments of the apparatus 100 wherein the plurality of layers of rounded objects 400 comprise one or more spherical objects 401 and one or more elliptical objects 402.

Figure 5A:
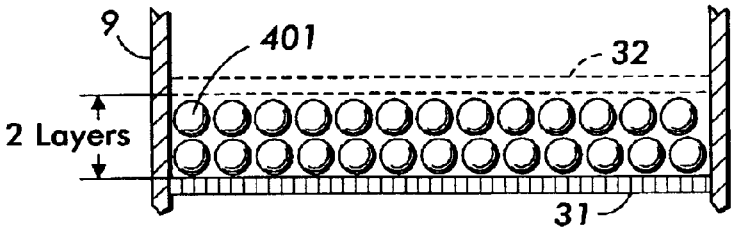
FIG. 5A depicts the apparatus 100 with two layers of the spherical objects 401.
Figure 5B:
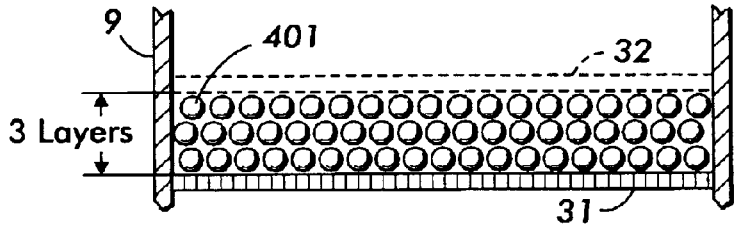
FIG. 5B depicts the apparatus 100 with three layers of the spherical objects 401.
Figure 5C:
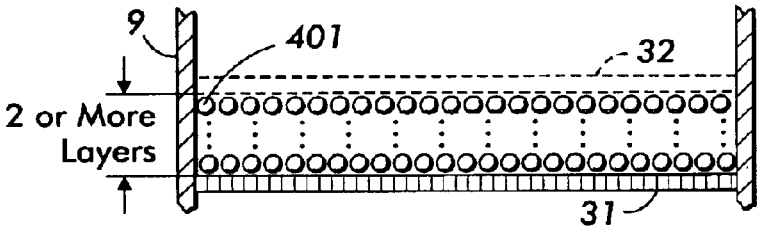
FIG. 5C depicts the apparatus 100 with-two or more layers of the spherical objects 401.

Refer now to FIG. 5, comprising three separate views respectively designated FIGS. 5A, 5B and 5C. In FIG. 5A there is depicted one embodiment of the apparatus 100 wherein the plurality of layers of rounded objects 400 comprise two (2) layers of the spherical objects 401. In FIG. 5B there is depicted another embodiment of the apparatus 100 wherein the plurality of layers of rounded objects 400 comprise three (3) layers of the spherical objects 401. In FIG. 5C there is depicted still another embodiment of the apparatus 100 wherein the plurality of layers of rounded objects 400 comprise two or more (i.e., 2, 3, 4, 5, or a still greater number, etc.) layers of the spherical objects 401.

Figure 6A:
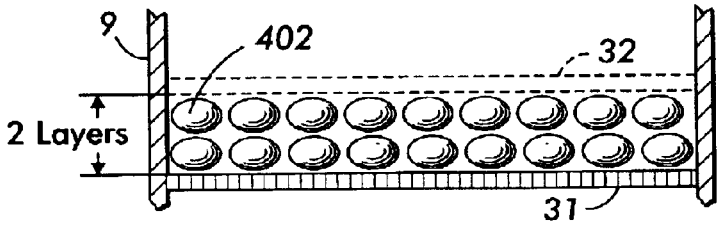
FIG. 6A depicts the apparatus 100 with two layers of the elliptical objects 402.
Figure 6B:
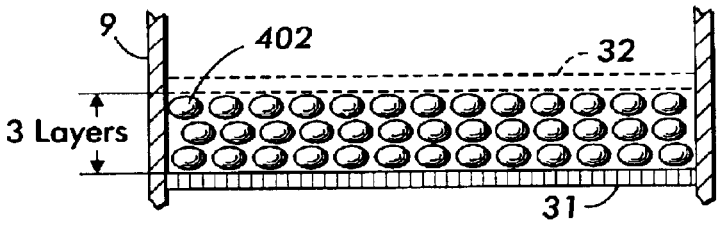
FIG. 6B depicts the apparatus 100 with three layers of the elliptical objects 402.
Figure 6C:
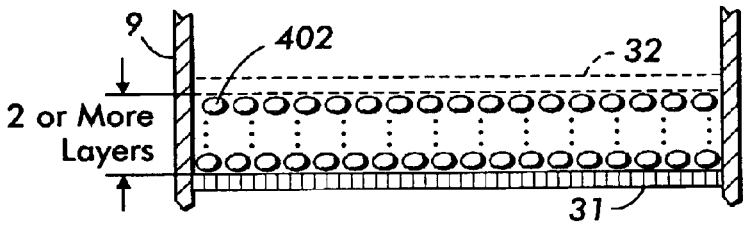
FIG. 6C depicts the apparatus 100 with two or more layers of the elliptical objects 402.

Refer now to FIG. 6, comprising three separate views respectively designated FIGS. 6A, 6B and 6C.

In FIG. 6A there is depicted one embodiment of the apparatus 100 wherein the plurality of layers of rounded objects 400 comprise two (2) layers of the elliptical objects 402. In one embodiment of FIG. 6A, substantially all such elliptical objects 402 are comprised of an identical elliptical shape, such as, for example, only one of the elliptical object embodiments 402', 402" and 402'" depicted in FIG. 4. In another contrasting embodiment of FIG. 6A, such elliptical objects 402 are comprised of different elliptical shapes, such as, for example, at least two of the elliptical object embodiments 402', 402" and 402'" depicted in FIG. 4.

In FIG. 6B there is depicted another embodiment of the apparatus 100 wherein the plurality of layers of rounded objects 400 comprise three (3) layers of the elliptical objects 402. In one embodiment of FIG. 6B, substantially all such elliptical objects 402 are comprised of an identical elliptical shape, such as, for example, only one of the elliptical object embodiments 402', 402" and 402'" depicted in FIG. 4. In another contrasting embodiment of FIG. 6B, such elliptical objects 402 are comprised of different elliptical shapes, such as, for example, at least two of the elliptical object embodiments 402', 402" and 402'" depicted in FIG. 4.

In FIG. 6C there is depicted still another embodiment of the apparatus 100 wherein the plurality of layers of rounded objects 400 comprise two or more (i.e., 2, 3, 4, 5, or a still greater number, etc.) layers of the elliptical objects 402. In one embodiment of FIG. 6C, substantially all such elliptical objects 402 are comprised of an identical elliptical shape, such as, for example, only one of the elliptical object embodiments 402', 402" and 402'" depicted in FIG. 4. In another contrasting embodiment of FIG. 6C, such elliptical objects 402 are comprised of different elliptical shapes, such as, for example, at least two of the elliptical object embodiments 402', 402" and 402'" depicted in FIG. 4.

Figure 7A:
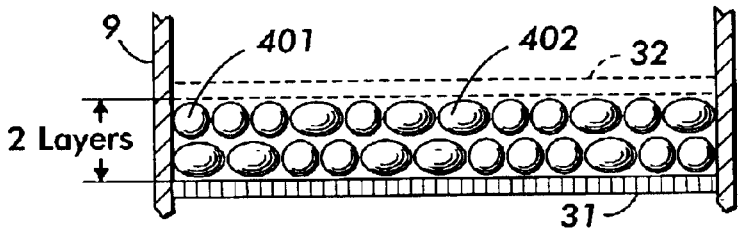
FIG. 7A depicts the apparatus 100 with two layers of rounded objects 400 comprising one or more spherical objects 401 and one or more elliptical objects 402.
Figure 7B:
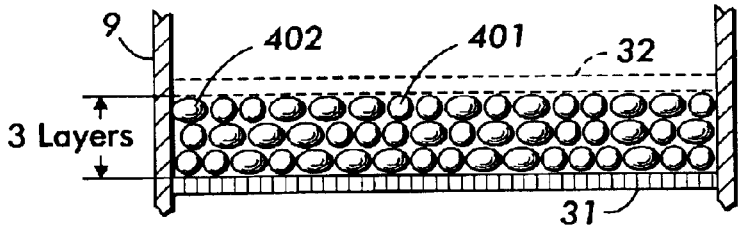
FIG. 7B depicts the apparatus 100 with three layers of rounded objects 400 comprising one or more spherical objects 401 and one or more elliptical objects 402.
Figure 7C:
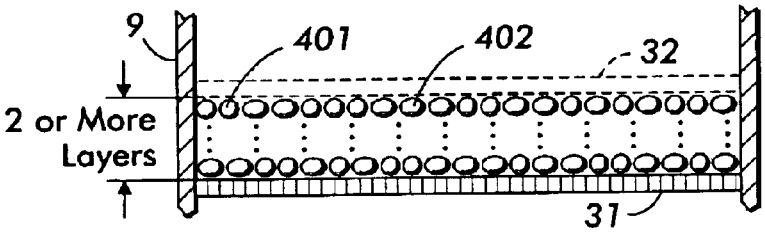
FIG. 7C depicts the apparatus 100 with two or more layers of rounded objects 400 comprising one or more spherical objects 401 and one or more elliptical objects 402.

Refer now to FIG. 7, comprising three separate views respectively designated FIGS. 7A, 7B and 7C.

In FIG. 7A there is depicted one embodiment of the apparatus 100 wherein the plurality of layers of rounded objects 400 comprise two (2) layers of rounded objects 400 comprising one or more spherical objects 401 and one or more elliptical objects 402. In one embodiment of FIG. 7A, the two (2) layers of rounded objects 400 comprise a fixed or predetermined combination or arrangement of one or more spherical objects 401 and one or more elliptical objects 402. In another embodiment of FIG. 7A, the two (2) layers of rounded objects 400 comprise an arbitrary or random combination or arrangement of one or more spherical objects 401 and one or more elliptical objects 402. In a further embodiment of FIG. 7A, the two (2) layers of rounded objects 400 comprise only one (1) spherical object 401. In a still further embodiment of FIG. 7A, the two (2) layers of rounded objects 400 comprise only one (1) elliptical object 402.

In FIG. 7B there is depicted another embodiment of the apparatus 100 wherein the plurality of layers of rounded objects 400 comprise three (3) layers of rounded objects 400 comprising one or more spherical objects 401 and one or more elliptical objects 402. In one embodiment of FIG. 7B, the three (2) layers of rounded objects 400 comprise a fixed or predetermined combination or arrangement of one or more spherical objects 401 and one or more elliptical objects 402. In another embodiment of FIG. 7B, the three (2) layers of rounded objects 400 comprise an arbitrary or random combination or arrangement of one or more spherical objects 401 and one or more elliptical objects 402. In a further embodiment of FIG. 7B, the three (3) layers of rounded objects 400 comprise only one (1) spherical object 401. In a still further embodiment of FIG. 7B, the three (3) layers of rounded objects 400 comprise only one (1) elliptical object 402.

In FIG. 7C there is depicted still another embodiment of the apparatus 100 wherein the plurality of layers of rounded objects 400 comprise two (2) or more (i.e., 2, 3, 4, 5, or a still greater number, etc.) layers of rounded objects 400 comprising one or more spherical objects 401 and one or more elliptical objects 402. In one embodiment of FIG. 7C, the two (2) or more layers of rounded objects 400 comprise a fixed or predetermined combination or arrangement of one or more spherical objects 401 and one or more elliptical objects 402. In another embodiment of FIG. 7C, the two (2) or more layers of rounded objects 400 comprise an arbitrary or random combination or arrangement of one or more spherical objects 401 and one or more elliptical objects 402. In a further embodiment of FIG. 7C, the two (2) or more layers of rounded objects 400 comprise only one (1) spherical object 401. In a still further embodiment of FIG. 7C, the two (2) or more layers of rounded objects 400 comprise only one (1) elliptical object 402.

In addition to disclosing the apparatus 100 depicted in FIG. 1 and described hereinabove, it will be understood that there has also been disclosed a method.

In particular, there has been disclosed a method for coating at least one substrate with a fluid 200 using the apparatus 100, the apparatus 100 comprising at least one diptank 10 defining an inlet 1 and a conduit 9 with an orifice 11, the conduit 9 including means 31–32 for suspending a plurality of layers of rounded objects 400, so that fluid 200 supplied 2A to the inlet 1 flows 2B through the plurality of layers of rounded objects 400 to coat 2C a substrate that is inserted 80 through the orifice 11, the method comprising supplying 2A fluid to the inlet 1 and inserting 80 at least one substrate through the orifice 11.

Moreover, in one embodiment of the foregoing method, it will be understood that the at least one substrate comprises a photoreceptor substrate 20A or 20B and the fluid 200 comprising photoreceptor coating solution.

In summary, this invention suspends plural layers of non-contaminating rounded objects, commonly known as "beads", between suspension devices such as mesh screens. These layers of rounded objects are then placed in the bottom of the dip tank. As a-result, the photoreceptor substrate coating process becomes more uniform, which reduces coating defects in the resulting finished photoreceptor belts or drums.

While not essential to practicing the invention, one possible theory of operation is that the layers of rounded objects create additional shear in the solution as it is being pumped into the tank. According to this theory, the increased shear in the solution reduces flocculation, reduces solvent-rich and pigment-rich zones in the tank, disperses the flow in the tank, and eliminates stagnant zones which trap contaminants.

While various embodiments of an apparatus and method for coating photoreceptor substrates, in accordance with the invention, have been described hereinabove, the scope of the invention is defined by the following claims.

What is claimed is:

1. An apparatus for coating at least one substrate with a fluid, the apparatus comprising at least one vertically-oriented diptank with a diptank top and a diptank bottom, the diptank defining an inlet at the diptank bottom and a vertically-oriented conduit with an orifice at the diptank top, the conduit including a plurality of horizontally-oriented layers of rounded objects suspended therein by means of an included suspending means, wherein the suspending means comprises at least two separate porous elements arranged in the conduit so as to provide an upper and lower porous element so that fluid supplied to the inlet at the diptank bottom flows upwards through the at least two porous elements and the plurality of layers of rounded objects and later continues to flow upwards to coat a substrate that is inserted through the orifice at the diptank top.

2. The apparatus of claim 1, where the at least two porous elements each have plurality of apertures dispersed throughout.

3. The apparatus of claim 2, the at least one substrate comprising a photoreceptor substrate and the fluid comprising photoreceptor coating solution.

4. The apparatus of claim 3, the at least one photoreceptor substrate comprising a belt.

5. The apparatus of claim 3, the at least one photoreceptor substrate comprising a cylindrical-shaped drum.

6. The apparatus of claim 3, the plurality of layers of rounded objects being suspended near the bottom of the diptank.

7. The apparatus of claim 2, each porous element comprising a grid, screen or mesh.

8. The apparatus of claim 2, the plurality of layers of rounded objects comprising two layers of rounded objects.

9. The apparatus of claim 8, the two layers of rounded objects generally comprising spherically-shaped objects.

10. The apparatus of claim 8, the two layers of rounded objects generally comprising elliptically-shaped objects.

11. The apparatus of claim 8, the two layers of rounded objects comprising one or more spherically-shaped objects and one or more elliptically-shaped objects.

12. The apparatus of claim 2, the plurality of layers of rounded objects comprising three layers of rounded objects.

13. The apparatus of claim 12, the three layers of rounded objects generally comprising spherically-shaped objects.

14. The apparatus of claim 12, the three layers of rounded objects generally comprising elliptically-shaped objects.

15. The apparatus of claim 12, the three layers of rounded objects comprising one or more spherically-shaped objects and one or more elliptically-shaped objects.

16. The apparatus of claim 2, the plurality of layers of rounded objects comprising two or more layers of rounded objects.

17. The apparatus of claim 16, the two or more layers of rounded objects generally comprising spherically-shaped objects.

18. The apparatus of claim 16, the two or more layers of rounded objects generally comprising elliptically-shaped objects.

19. The apparatus of claim 16, the two or more layers of rounded objects comprising one or more spherically-shaped objects and one or more elliptically-shaped objects.

20. The apparatus of claim 2, the rounded objects generally comprised of glass.

21. The apparatus of claim 2, the rounded objects generally comprised of a ceramic material.

22. The apparatus of claim 21, the ceramic material comprising porcelain, aluminum oxide or titanium dioxide.

23. The apparatus of claim 2, he rounded objects generally comprised of metal.

24. The apparatus of claim 23, the metal comprising aluminum, stainless steel or titanium.

* * * * *